US007170022B2

(12) United States Patent
Krajci et al.

(10) Patent No.: US 7,170,022 B2
(45) Date of Patent: Jan. 30, 2007

(54) ARCHITECTURAL PRESET ROTARY AND PRESET SLIDE CONTROL AND NON-PRESET CONTROLS

(75) Inventors: Edward J. Krajci, Garden City South, NY (US); Fred R. Meiners, Wantagh, NY (US); Michael Khleb, Old Bridge, NJ (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 11/283,987

(22) Filed: Nov. 21, 2005

(65) Prior Publication Data

US 2006/0070865 A1 Apr. 6, 2006

Related U.S. Application Data

(63) Continuation of application No. 10/810,243, filed on Mar. 26, 2004, now Pat. No. 6,967,301.

(51) Int. Cl.
*H01H 17/02* (2006.01)

(52) U.S. Cl. ..... 200/547; 200/536; 338/114

(58) Field of Classification Search ..... 200/547–549, 200/529, 536, 564–570, 5 R, 1 R, 336, 178, 200/176; 338/114, 47, 162
See application file for complete search history.

(56) References Cited

U.S. PATENT DOCUMENTS 3,676,827 A * 7/1972 Nomura ..... 338/183
4,200,780 A * 4/1980 Romano ..... 463/37
4,880,950 A * 11/1989 Carson et al. ..... 200/547
5,225,804 A * 7/1993 Silbelus ..... 338/153
5,731,558 A * 3/1998 Kyoden ..... 200/5 R
6,028,502 A * 2/2000 McSwiggen ..... 338/167
6,069,327 A * 5/2000 Ushimaru ..... 200/5 R
6,153,837 A * 11/2000 Garcia et al. ..... 200/18
6,515,241 B2 * 2/2003 Saiki ..... 200/5 R

* cited by examiner

*Primary Examiner*—Kyung Lee
(74) *Attorney, Agent, or Firm*—Paul J. Sutton

(57) ABSTRACT

An architectural preset rotary and preset slide control device comprising an N-mode latch mechanically coupled to a switch having a pole and a plurality of receiving terminals. The device further comprises a variable control component that is electrically coupled to the switch such that when the latch is activated into one of the N modes, the switch pole is caused to be electrically coupled to one of the receiving terminals allowing electrical energy at the pole to be routed through the switch to one of the receiving terminals. The variable control component controls the amount of electrical energy that is routed through the switch. The device has a modular design in that the switch, latch, variable control component and other parts of the device are single piece parts that facilitate the assembly of the device during its manufacture.

1 Claim, 3 Drawing Sheets

ARCHITECTURAL PRESET ROTARY AND PRESET SLIDE CONTROL AND NON-PRESET CONTROLS

This application is a continuation of application Ser. No. 10/810,243, filed Mar. 26, 2004, now U.S. Pat. No. 6,967, 301.

BACKGROUND OF THE INVENTION

1. Field of the Invention

The present invention generally relates to electromechanical rotary and slide control switches.

2. Description of the Related Art

Electromechanical switches for controlling electrical devices and/or systems such as lighting systems typically comprise many electrical components and mechanical components that are electrically and/or mechanically coupled to each other. Depending on the particular application, the systems and/or devices that are controlled by the switches often require multiple simultaneous application and control of electrical energy in the form of electrical current or voltage. The application of electrical energy is typically implemented with a switch that electrically connects or disconnects the electrical device or system to or from a source of electrical energy. The control of electrical energy is typically implemented with a variable control arrangement such as a variable potentiometer that selectively controls the amount of voltage or current that is supplied to the electrical devices and/or systems. The design of such switches is often complicated by the need to route electrical energy to devices or systems while at the same controlling the amount of energy being provided to these devices or systems. Consequently, these switches often have very awkward control and switching actuators that are difficult to manipulate by an operator. Further, the assembly of these switches during manufacture is also difficult because of the relatively small size of the switch electrical and mechanical components and the intricate interconnections that often exist between these various components.

What is therefore needed is a switch that can be manipulated to operate in one of a plurality of modes in a relatively simple fashion. What is further needed is a switch whose design renders its assembly during manufacturing relatively simple.

SUMMARY OF THE INVENTION

The present invention provides an architectural preset rotary and slide control device that is used to route electrical energy to devices and/or systems and to control the amount of electrical energy routed to the electrical devices and/or systems. The device of the present invention has a modular design which facilitates assembly of such device during its manufacture. The device of the present invention comprises an N-mode latch that is mechanically coupled to a switch whereby the operation of the latch causes the device to route electrical energy through the switch to one of a plurality of electrical devices and/or systems each of which is electrically coupled to a terminal of the switch. The device further comprises a variable control component electrically coupled to the switch and other electrical components such that when this component is operated it controls the amount of electrical energy that is routed through the switch of the device of the present invention. In a preferred embodiment, the latch is configured so as to enter one of N modes each time it is activated; N is an integer equal to 2 or greater.

The latch has a plunger that extends from the latch body. When the latch is activated, i.e., when the plunger is depressed, the amount that the plunger extends from the plunger body changes to a specific length corresponding to a mode of the latch. The extended plunger thus engages the switch at different preset positions corresponding to different modes of the latch and the switch. The switch has a pole terminal and a plurality of receiving terminals one of which is caused to be electrically coupled to the pole terminal upon engagement of the switch. The switch is engaged by pushing a switch actuator (or switch button). Depending on the extent to which the switch actuator or button is pressed, the pole of the switch is caused to electrically couple to one of the plurality of receiving terminals thereby setting the switch into a particular switch mode.

The switch has a plurality of modes each corresponding to a particular preset position of the switch actuator which corresponds to the electrical coupling of the pole to one of a plurality of receiving terminals. In other words, each time the latch is activated, it engages the switch at a different preset position thereby causing the switch to electrically couple its pole to one of a plurality of receiving terminals thereby routing electrical energy or electrical signals at the pole to one of a plurality of receiving terminals. The variable control component is configured as a rotary control or slide control potentiometer electrically coupled to the switch along with other electrical components to control the amount of energy that is routed through the switch.

The design of the device of the present invention is modular in that many of the various components are implemented as single piece components or modules that can be easily assembled during the manufacture of the device. In particular, the latch is a one-piece component that mates with a one-piece latch lock spring retainer. Further, the switch is a one-piece electromechanical part with terminals one of which is a pole ant the others are receiving terminals. The device of the present invention also has a one-piece housing or in another embodiment a two-piece housing arrangement where the housing components mate with each other. The variable control component is also a one-piece device. As with most modular designs, many of the components are interchangeable with other similar components thus allowing the device of the present invention to be constructed in a variety of arrangements.

DETAILED DESCRIPTION

Figure 1:
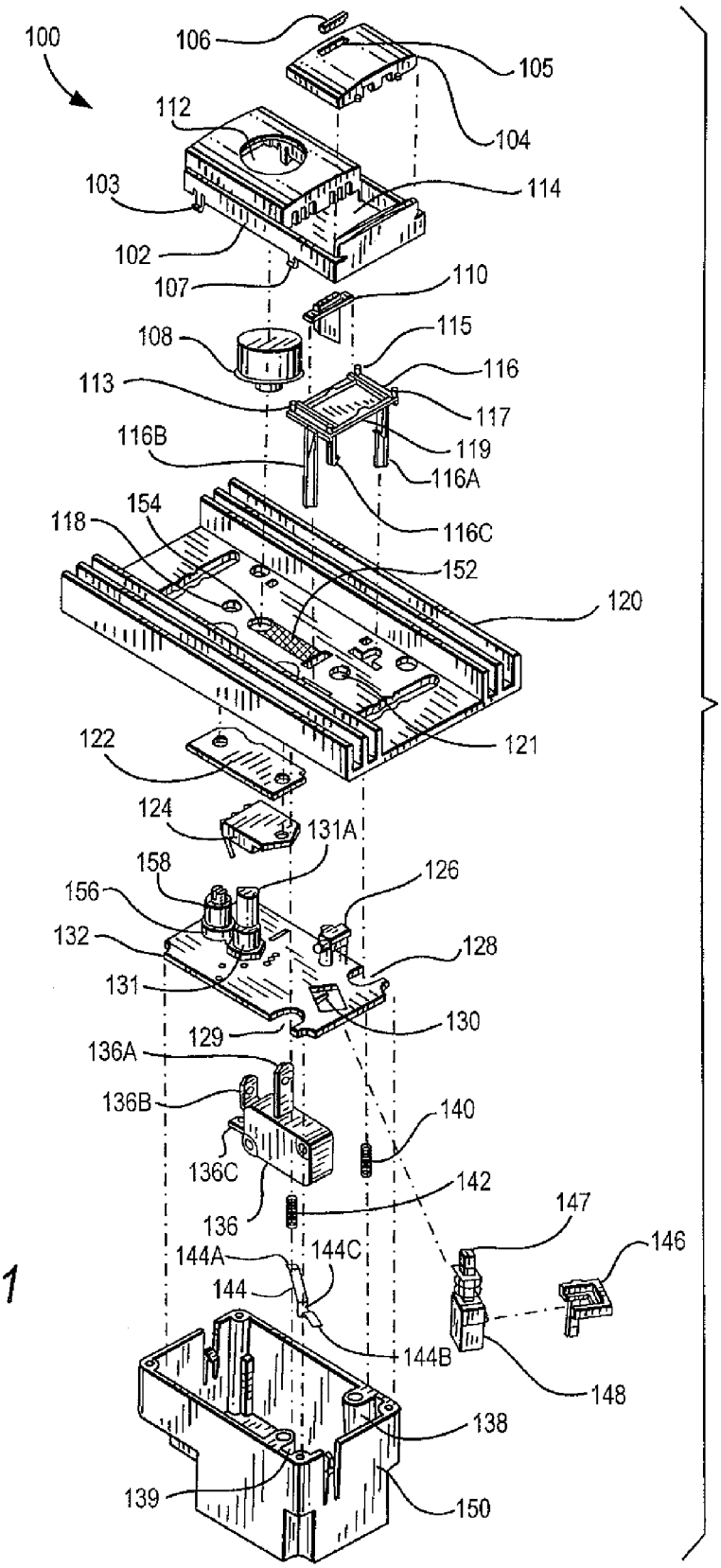
FIG. 1 shows an exploded perspective view of the device of the present invention having preset rotary controls with and without latching potentiometer shaft.

The present invention provides an architectural preset rotary and slide control device that is used to route electrical energy to devices and/or systems and to control the amount of electrical energy routed to the electrical devices and/or systems. The device of the present invention has a modular design which facilitates assembly of such device during its manufacture. The device of the present invention comprises an N-mode latch that is mechanically coupled to a switch whereby the operation of the latch causes the device to route electrical energy through the switch to one of a plurality of electrical devices and/or systems each of which is electrically coupled to a terminal of the switch. The device further comprises a variable control component electrically coupled to the switch and other electrical components such that when this component is operated it controls the amount of electrical energy that is routed through the switch of the device of the present invention. In a preferred embodiment, the latch is configured so as to enter one of N modes each time it is activated; N is an integer equal to 2 or greater.

The latch has a plunger that extends from the latch body. When the latch is activated, i.e., when the plunger is depressed, the amount that the plunger extends from the plunger body changes to a specific length corresponding to a mode of the latch. The extended plunger thus engages the switch at different preset positions corresponding to different modes of the latch and the switch. The switch has a pole terminal and a plurality of receiving terminals one of which is caused to be electrically coupled to the pole terminal upon engagement of the switch. The switch is engaged by pushing a switch actuator (or switch button). Depending on the extent to which the switch actuator or button is pressed, the pole of the switch is caused to electrically couple to one of the plurality of receiving terminals thereby setting the switch into a particular switch mode.

The switch has a plurality of modes each corresponding to a particular preset position of the switch actuator which corresponds to the electrical coupling of the pole to one of a plurality of receiving terminals. In other words, each time the latch is activated, it engages the switch at a different preset position thereby causing the switch to electrically couple its pole to one of a plurality of receiving terminals thereby routing electrical energy or electrical signals at the pole to one of a plurality of receiving terminals. The variable control component is configured as a rotary control or slide control potentiometer electrically coupled to the switch along with other electrical components to control the amount of energy that is routed through the switch.

The design of the device of the present invention is modular in that many of the various components are implemented as single piece components or modules that can be easily assembled during the manufacture of the device. In particular, the latch is a one-piece component that mates with a one-piece latch lock spring retainer. Further, the switch is a one-piece electromechanical part with terminals one of which is a pole and the others are receiving terminals. The device of the present invention also has a one-piece housing or in another embodiment a two-piece housing arrangement where the housing components mate with each other. The variable control component is also a one-piece device. As with most modular designs, many of the components are interchangeable with other similar components thus allowing the device of the present invention to be constructed in a variety of arrangements.

Referring now to FIG. 1 there is shown the present invention having pushbutton 104 and rotary knob 108 controls. Push button 104 and rotary knob 108 are part of a frame assembly comprising frame 102 having openings 112 and 114. Pushbutton 104 and rotary knob 108 are mounted to frame 102 through openings 112 and 114. Pushbutton 104 fits within opening 114 of frame 102 such that it is movable within and through opening 114. Pushbutton 104 has a slot 105 which is used to install lens 106 thereto. Frame 102 has flanges (only two are shown, 103 and 107) that frictionally engage openings in heat sink 120 so that frame 102 is securely mounted onto heat sink 120. Actuator 116 having four legs, viz., front side legs 116A, 116B and rear legs 116C (engages heat sink 120) and 116D (not shown), is positioned underneath pushbutton 104 such that actuator 116 couples to pushbutton 104 by the insertion of actuator dowels 113, 119, 115, 117 into corresponding receiving compartments (not shown) underneath and integral with pushbutton 104. Front legs 116A, 116B and rear legs 116C and 116D of actuator 116 extend through openings in heat sink 120 and cutout openings 128 and 129 of printed circuit board 132. Front legs 116A and 116B are guiding legs.

Housing 150 has hollow columns 138 and 139 into which springs 140 and 142 are inserted. Actuator legs 116A and 116B having been extended through cutout openings 128 and 129 of printed circuit board 132 further extend into hollow columns 138 and 139 and engage inserted springs 140 and 142 respectively. Rear legs 116C and 116D extend through openings of heat sink 120 and serve to hold actuator 116 to heat sink 120. Latch 148 snugly fits into latch lock spring retainer 146 and this latch/latch lock combination is placed within and attached to housing 150. Latch 148 is a two position latch meaning when plunger 147 is pressed it is latched into a preset depressed position and when plunger 147 is pressed again it changes to a preset extended position. Thus, plunger 147 alternates between a depressed position and an extended position when pressed consecutively. However, it will be readily understood by one of ordinary skill in the art to which this invention belongs that latch 148 can be configured such that each time plunger 147 is pressed, it is latched to a particular one of N preset positions where N is an integer equal to 2 or greater. For example, when N=4, plunger 147 will take a first position after it has been pressed a first time, then a second position after it has been pressed a second time, then a third and fourth positions after being pressed a third and fourth consecutive time. Plunger 147 can progressively extend from latch 148 each time it is pressed or it can progressively contract into latch 148. After having been pressed N times, plunger 147 returns to its original position and repeats the same preset positions as before. Latch 148 is thus said to have a cycle of N meaning that the plunger, when pressed consecutively N times, will have N different positions; latch 148 is thus an N-mode latch.

In the case discussed above where plunger 147 is fully extended or fully contracted each time it is pressed, the latch cycle is 2 or the latch has two modes of operation, i.e., N=2. The lower end of plunger 147 extends though latch 148 and makes contact with one end (144A) of leaf spring 144 positioned in a well (not shown) situated within housing 150. Leaf spring 144 is positioned such that when plunger 147 comes into contact with end 144A, leaf spring 144 partially rotates about leaf spring dimpled center portion 144C such that leaf spring end 144B moves upward toward the opening of housing 150. Leaf spring end 144B is in contact with micro-switch 136 having terminals 136A, 136B and 136C. Terminal 136A is the pole of switch 136 and terminals 136B and 136C are receiving terminals. The term 'micro switch' will hereinafter be used interchangeably with the term 'switch.' Micro switch is a particular type of switch which is relatively small in size. In a typical application an electrical energy source or a signal source is electrically coupled to pole 136A and electrical devices or systems are electrically coupled to terminals 136B and/or 136C. Micro switch 136 also has a switch actuator (not shown) extending downward (toward base of housing 150) and with which leaf spring end 144B makes contact. The switch actuator sets micro switch 136 into one of a plurality of different modes depending on the extent to which the actuator is pushed downwards. Thus, when pushing 104 and actuator 116 is pressed, actuator 116 presses plunger 147 which extends through printed circuit board 132 via opening 130 and through heat sink 120 via opening 121. For N=2, plunger 147 will be set to either its extended or depressed position engaging leaf spring end 144A causing leaf spring end 144B to activate micro switch 136 into one of two modes. That is, when plunger 147 is in its extended position, it pushes down on leaf spring end 144A to a relatively lesser extent then when it is in its depressed position. Correspondingly, leaf spring end 144B will push up relatively more on the switch actuator when lower portion of plunger 147 is in its extended position and leaf spring end 144B will push up relatively less on the switch actuator when the lower portion of plunger 147 is in its depressed position. Also, after push button 104 is pressed and released, it springs back into its original position from the recoil action of springs 140 and 142 positioned within hollow columns 138 and 139 of housing 150. Push-button 104 can thus be easily manipulated to operate latch 148 which operates switch 136 causing pole 136A to electrically couple to one of the receiving terminals, i.e., normally open terminal 136B or normally closed terminal 136C.

Printed circuit board 132 fits snugly into housing 150 covering micro switch 136, latch/latch lock spring retainer (146,148) combination, springs 140, 142 and leaf spring 144. Micro switch 136 is adhered to printed circuit board 132 through well known techniques such as soldering or through the coupling of electrical connectors (not shown) .Micro switch 136is constructed such that each time push button 104 is pressed (thus pressing plunger 147) the resulting position taken by plunger 147 correspond to a particular mode for micro switch 136. A mode for micro switch 136 means a particular electrical coupling between the pole of the switch and one of a plurality of receiving terminals. A mode correspond to a present position of the actuator of switch 136. Thus, a single pole triple throw (SPTT) switch has a pole terminal that can be electrically coupled to one of three receiving terminals depending on the selected. A first mode may be the pole terminal being electrically coupled to a first receiving terminal. A second mode may the pole terminal uncoupled from the first terminal and now electrically coupled to a second receiving terminals. In the embodiments shown in FIG. 1, a single pole double throw (SPDT) switch (136) is shown where the pole terminal 136A and the receiving terminals are terminals 136B and 136C. For N=4, leaf spring end 144B will push micro switch actuator to four different present position causing micro switch 136 to enter four different modes. The number of modes contained by micro switch 136 does not necessarily have to equal to the number of positions(i.e.,N) that can be taken by plunger 147. The number of modes contained by switch 136 can equal to N or can be less than N or greater than N.

Various electrical circuit components are mounted on printed circuit board 132. Some of the components are primary circuit potentiometer 131, secondary potentiometer 156 having shaft 158 and light emitting diode (LED) assembly 126 comprising an LED and an LED holder. Potentiometer 131 is used as the variable control component of the device of the present invention. It will be readily obvious to one skilled in the art to which this invention belongs that printed circuit board 132 may contain additional components which when electrically inter coupled with each other and with the aforementioned components form a circuit that can be activated by push button 104 (as explained above) or activated by engaging potentiometer 131 as explained below. Also, as part of the circuit, semiconductor switch device 124 (e.g., a triac) can be mounted onto printed circuit board 132 with heat spreader 122 sandwiched by and adhered to semiconductor switch device 124 and heat sink 120. Potentiometer 131 has shaft 131A that extends through opening 154 of heat sink 120. The underside of rotary knob 108 has a receiving compartment (not shown) in which a portion of shaft 131A is frictionally inserted so that when rotary knob 108 is rotated, shaft 131A correspondingly rotates. The rotation of rotary knob 108 operates part or all of the circuitry located on printed circuit board 132. When the LED of LED assembly 126 is activated, the resulting light is routed by light pipe 11O to lens 106. Secondary potentiometer 156 has shaft 158 which extends through opening 118 permitting an end user to set a low end voltage of a fan or lighting system.

Figure 2:
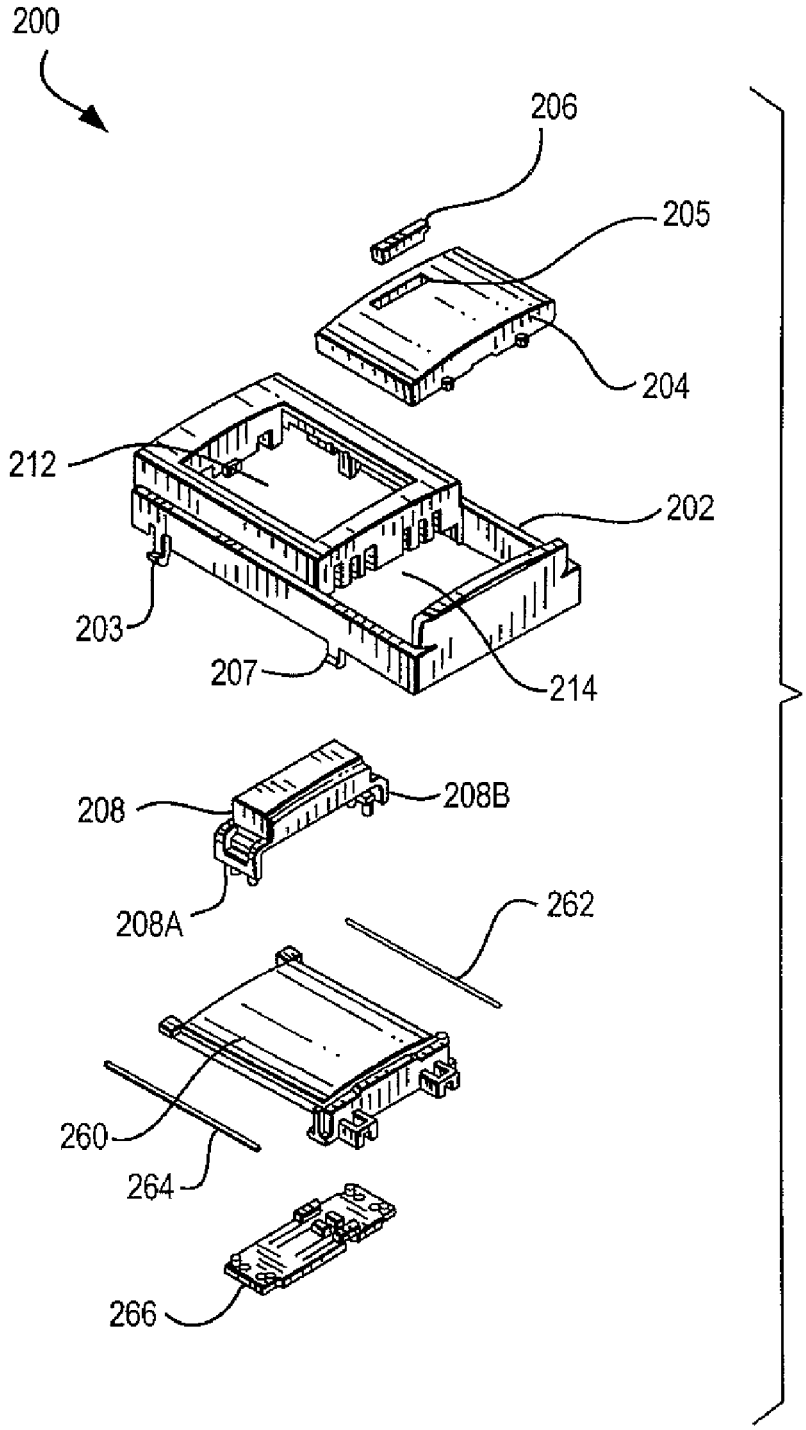
FIG. 2 shows an exploded perspective view of a preset slide control embodiment of the device of the present invention.

The shaft 131 A of primary circuit potentiometer 131 is configured to operate as a latch mechanism similar to latch 148. In particular, shaft 131A operates in a manner similar to plunger 147 of latch 148. That is, shaft 131A when pressed, takes either a preset depressed position or a preset extended position. In particular, rotary knob 108, which extends through and is vertically movable within opening 112, has a compartment (not shown) for receiving a portion of shaft 131A. Potentiometer 131 is thus a combination of a latch and variable potentiometer. Rotary knob 108 and shaft 131A are thus coupled to each other such that when rotary knob 108 is pressed, the latch that is integral with potentiometer 131 causes shaft 131A to be in either a depressed position whereby rotary knob 108 is substantially flush with the upper surface of frame 102 or takes an extended position whereby rotary knob 108 extends through opening 112. When shaft 131A is in the extended position, rotary knob 108 can be rotated to vary the resistance of potentiometer 131 and thus provide variable control of the associated Referring now to FIG. 2, there is shown a portion of another embodiment of the present invention in which the variable control component is a slide control arrangement instead of the rotary control described above. In particular, a frame assembly is shown comprising frame 202 having openings 212 and 214. Push button 204 fits within opening 214 of frame 202 such that it is movable within and through opening 214. Push button 204 has a slot 205 which is used to install lens 206. The slide control arrangement comprises guide bars 262 and 264 fixedly attached to opposing side of glide plate 260 to allow slider 208 to slidably engage the guide bars with slider arms 208A and 208B. The slider arms 208A and 208B are coupled to opposite ends of slider bar 266 to form a sliding actuator that engages a variable sliding potentiometer (not shown). Slider bar 266 has a groove or linear slot (not shown) that is used to fixedly capture an extended slide (not shown) of the variable sliding potentiometer positioned underneath slider bar 266 and mounted on a printed circuit board similar to printed circuit board 132 shown in FIG. 1. Thus, as the sliding actuator is moved along guide plate 260, the extended slide of the variable sliding potentiometer moves correspondingly operating part or all of any circuitry (also mounted on the printed circuit board) associated with the variable sliding potentiometer and/or providing variable control of the circuitry.

Figure 3:
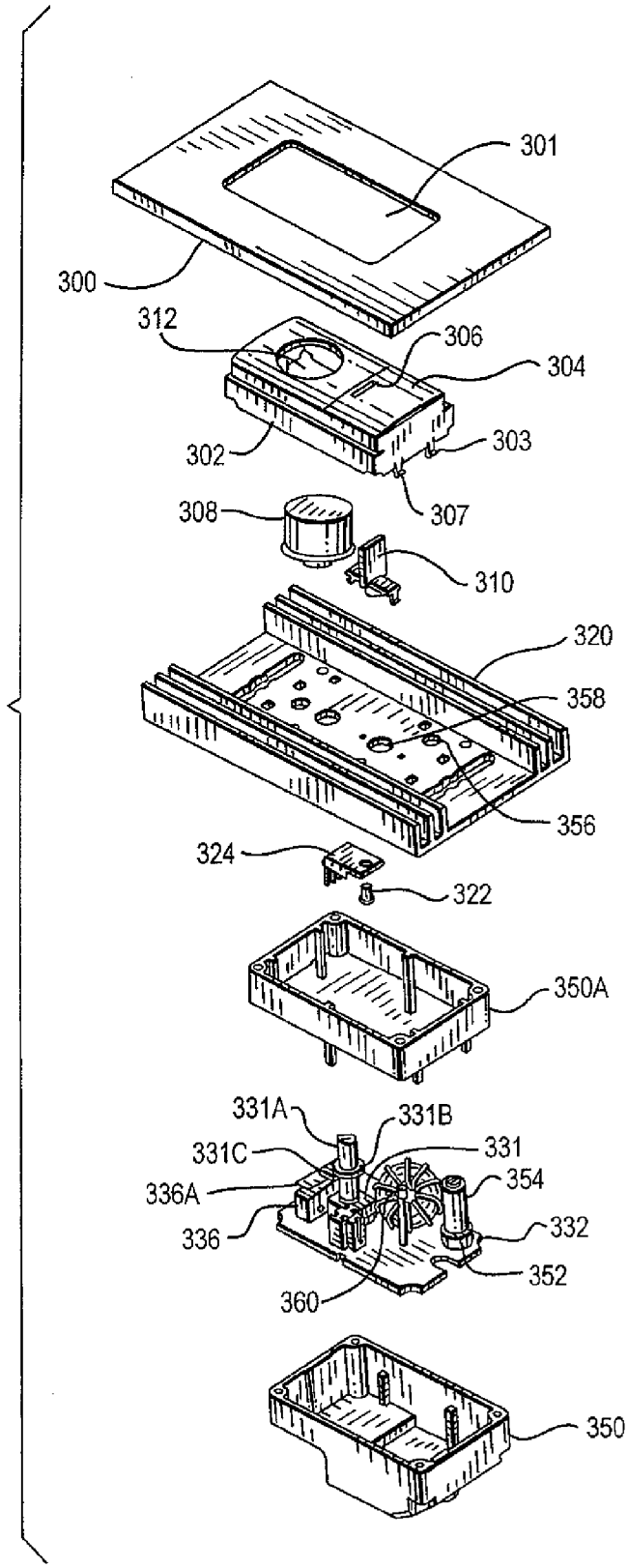
FIG. 3 shows an exploded perspective view of a non-preset rotary control embodiment of the device of the present invention.

Referring now to FIG. 3, there is shown yet another embodiment of the present invention. Cover plate 300 has opening 301 through which frame assembly 302 extends. Frame assembly 302 has opening 312 through which rotary knob 308 extends. Frame assembly 302 has flanges (only 303 and 307 are shown) That frictionally fit into openings in heat sink 320 so that frame 320 is securely mounted onto heat sink 320. Shaft 331A of potentiometer 331 has an axially extended cam member 331C that makes contact with lever 336A of switch 336. Thus, when rotary knob 308 is rotated, axial cam member 331C accordingly frictionally engages and thus presses down on lever 336A causing switch 336 to effect a switching operation and enter a particular mode. Lever 336A operates in the same manner as the switch actuator (not shown) discussed with respect to FIG. 1 for single pole on-off switching of a load.

Switch 336 can operate similarly to switch 136 of FIG. 1,in that it has a common pole terminal which electrically couples to one of a plurality of receiving terminals depending on the particular mode in which it is operating. Each time rotary knob 308 is rotated shaft 331A extends to a distinct position thus applying a distinct force on lever 336A of switch 336. Similarly to latch 148 of FIG. 1, potentiometer 331 can have a cycle N representing the number of different positions that can be taken by shaft 331A when rotary knob 308 is rotated in different directions, The embodiment shown in FIG. 3 further comprises light pipe 310 which routes light generated by an LED on printed circuit board 332 to lens 306. Bottom portion of light pipe 310 passes through opening 358 to retain LED mounted on printed circuit board 332. Printed circuit board 332 and components mounted thereto are placed in housing portion 350A positioned above and mates with housing portion 350. Triac 324, which is part of the circuitry mounted onto printed circuit board 332, is attached to heat sink 320 with rivet or eyelet 322. Triac 324 is also mounted onto printed circuit board 332 and thus is sandwiched between printed circuit board 332 and heat sink 320. Secondary potentiometer 352, which is mounted on printed circuit board 332, has a shaft 354 that extends through opening 356 of heat sink 320 allowing an end user to set a low end voltage of a fan or lighting system or load.

We claim:

1. An architectural preset rotary and slide control device comprising:

an N-mode latch having a plunger which can be depressed to a number of positions where N is an integer equal to 2 or greater;

a switch having a pole terminal and a plurality of receiving terminals where the switch is mechanically coupled to the plunger of the N-mode latch and the N-mode latch can be sequentially set to a plurality of modes by depressing the plunger where, depending on the number of times that the plunger is depressed, the pole terminal of the switch is coupled to one of the plurality of receiving terminals thereby setting the switch into a particular switch mode; and a variable control component electrically coupled to the switch where the amount of electrical energy that is routed through the switch is controlled by the mode to which the switch is set and wherein the plunger can be depressed to a number of positions which can be different than the number of N-modes in the latch.

* * * * *